US012623877B2

(12) United States Patent
Yamada

(10) Patent No.: US 12,623,877 B2
(45) Date of Patent: May 12, 2026

(54) SHEET FEEDING DEVICE AND PRINTING SYSTEM

(71) Applicant: Sota Yamada, Kanagawa (JP)

(72) Inventor: Sota Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 19/022,011

(22) Filed: Jan. 15, 2025

(65) Prior Publication Data

US 2025/0296793 A1 Sep. 25, 2025

(30) Foreign Application Priority Data

Mar. 22, 2024 (JP) ..... 2024-047108

(51) Int. Cl.

| | |
|---|---|
| ***B65H 29/62*** | (2006.01) |
| ***B65H 3/12*** | (2006.01) |
| ***B65H 5/26*** | (2006.01) |
| ***B65H 7/06*** | (2006.01) |
| ***B65H 7/14*** | (2006.01) |

(52) U.S. Cl.

CPC ..... *B65H 29/62* (2013.01); *B65H 3/128* (2013.01); *B65H 5/26* (2013.01); *B65H 7/06* (2013.01); *B65H 7/14* (2013.01); *B65H 2405/15* (2013.01); *B65H 2511/52* (2013.01); *B65H 2511/522* (2013.01); *B65H 2513/42* (2013.01); *B65H 2513/50* (2013.01); *B65H 2553/40* (2013.01); *B65H 2801/06* (2013.01)

(58) Field of Classification Search

CPC ..... B65H 5/224; B65H 7/06; B65H 7/14; B65H 7/20; B65H 29/62; B65H 3/128; B65H 29/60; B65H 2511/521; B65H 5211/522; B65H 31/24; B65H 5/26; B65H 5/222; B65H 5/226; B65H 5/08; B65H 5/085; B65H 5/10; B65H 5/12; B65H 5/14

See application file for complete search history.

(56) References Cited

U.S. PATENT DOCUMENTS

| | | | | |
|---|---|---|---|---|
| 8,262,080 | B2 * | 9/2012 | Matsumoto | B65H 3/128 271/97 |
| 11,603,277 | B2 * | 3/2023 | Maeda | B65H 7/16 |
| 12,479,218 | B2 * | 11/2025 | Fukunaga | B41J 11/42 |

FOREIGN PATENT DOCUMENTS

| | | | |
|---|---|---|---|
| JP | H01-048733 | A | 2/1989 |
| JP | 2001-220031 | A | 8/2001 |
| JP | 2008-254928 | A | 10/2008 |
| JP | 2010-089943 | A | 4/2010 |
| JP | 2019-026449 | A | 2/2019 |

* cited by examiner

*Primary Examiner* — Jeremy R Severson

(74) *Attorney, Agent, or Firm* — Harness, Dickey & Pierce, P.L.C.

(57) ABSTRACT

A sheet feeding device includes a sheet stacker, a conveyor, a sensor, circuitry, and a changing unit. The conveyor conveys a sheet from the sheet stacker by suction. The sensor detects a state of the sheet before the sheet is conveyed from the sheet stacker. The circuitry determines the state of the sheet based on a detection result of the sensor. The changing unit changes a passage to convey the sheet based on a determination result.

7 Claims, 8 Drawing Sheets

SHEET FEEDING DEVICE AND PRINTING SYSTEM

CROSS-REFERENCE TO RELATED APPLICATION

This patent application is based on and claims priority pursuant to 35 U.S.C. § 119 (a) to Japanese Patent Application No. 2024-047108, filed on Mar. 22, 2024, in the Japan Patent Office, the entire disclosure of which is hereby incorporated by reference herein.

BACKGROUND

Technical Field

The present disclosure relates to a sheet feeding device and a printing system.

Related Art

When an inferior (folded or torn) sheet of paper is set in a sheet feeding apparatus, the sheet may collide with a passage through which the sheet is conveyed for printing and cause a paper jam. The paper jam during printing causes downtime of machine printing due to the removal of the sheet and the resuming of printing. Therefore, it is important to detect the state of a sheet that may cause a paper jam and remove an abnormal sheet in advance.

SUMMARY

According to an embodiment of the present disclosure, a sheet feeding device includes a sheet stacker, a conveyor, a sensor, circuitry, and a changing unit. The conveyor conveys a sheet from the sheet stacker by suction. The sensor detects a state of the sheet before the sheet is conveyed from the sheet stacker. The circuitry determines the state of the sheet based on a detection result of the sensor. The changing unit changes a passage to convey the sheet based on a determination result.

According to an embodiment of the present disclosure, a printing system includes the sheet feeding device and an image forming apparatus to form an image on the sheet conveyed by the sheet feeding device.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
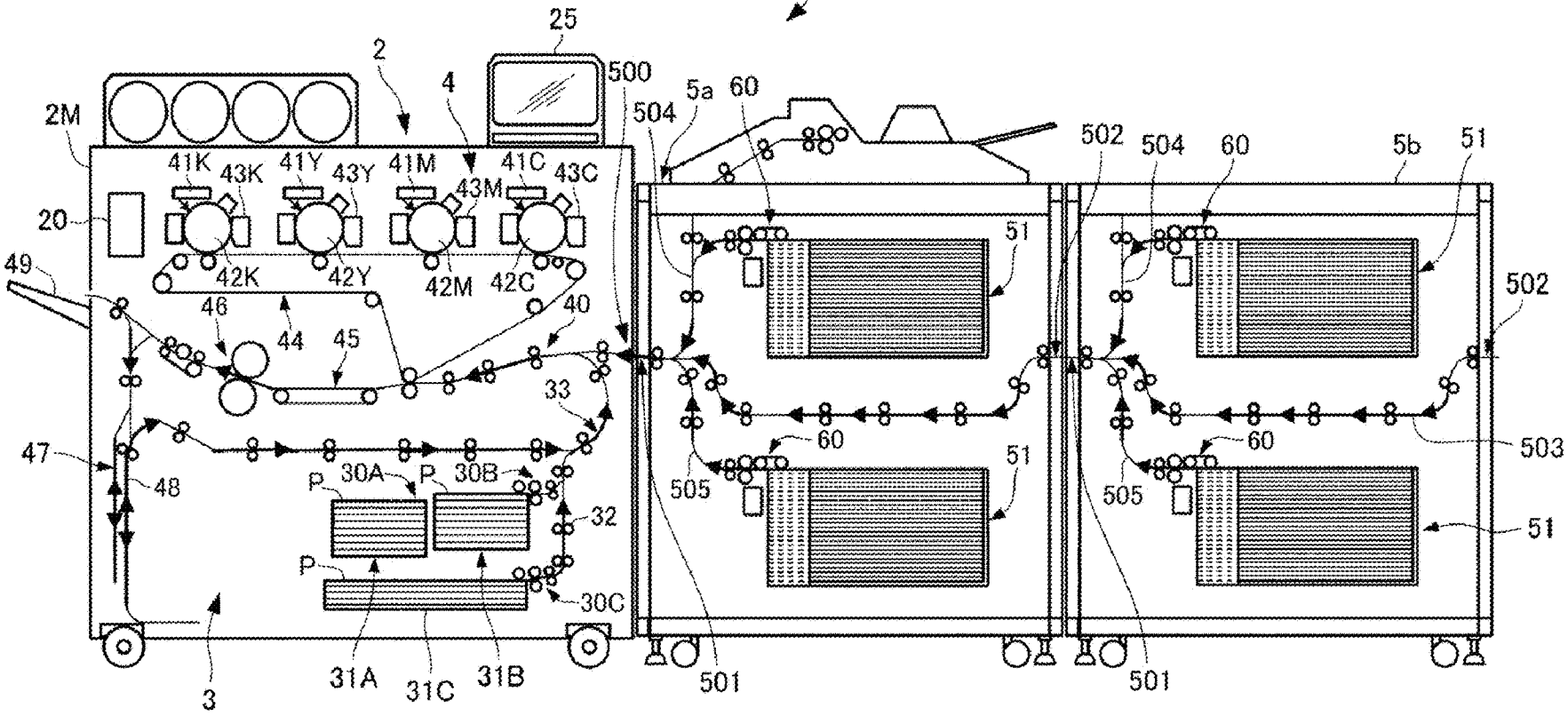
FIG. 1 is a side view of a printing system, illustrating an overall configuration of the printing system.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below.

As used herein, the singular forms "a," "an," and "the" are intended to include the plural forms as well, unless the context clearly indicates otherwise. The term "connected/coupled" includes both direct connections and connections in which there are one or more intermediate connecting elements.

For the sake of simplicity, like reference signs denote like elements such as parts and materials having the same functions, and redundant descriptions thereof are omitted unless otherwise required.

In the following description, suffixes Y, M, C, and K denote colors of yellow, magenta, cyan, and black, respectively. To simplify the description, these suffixes are omitted unless necessary.

Embodiments of a sheet feeding device, an image forming apparatus, and a printing system will be described in detail below with reference to the accompanying drawings.

Figure 2:
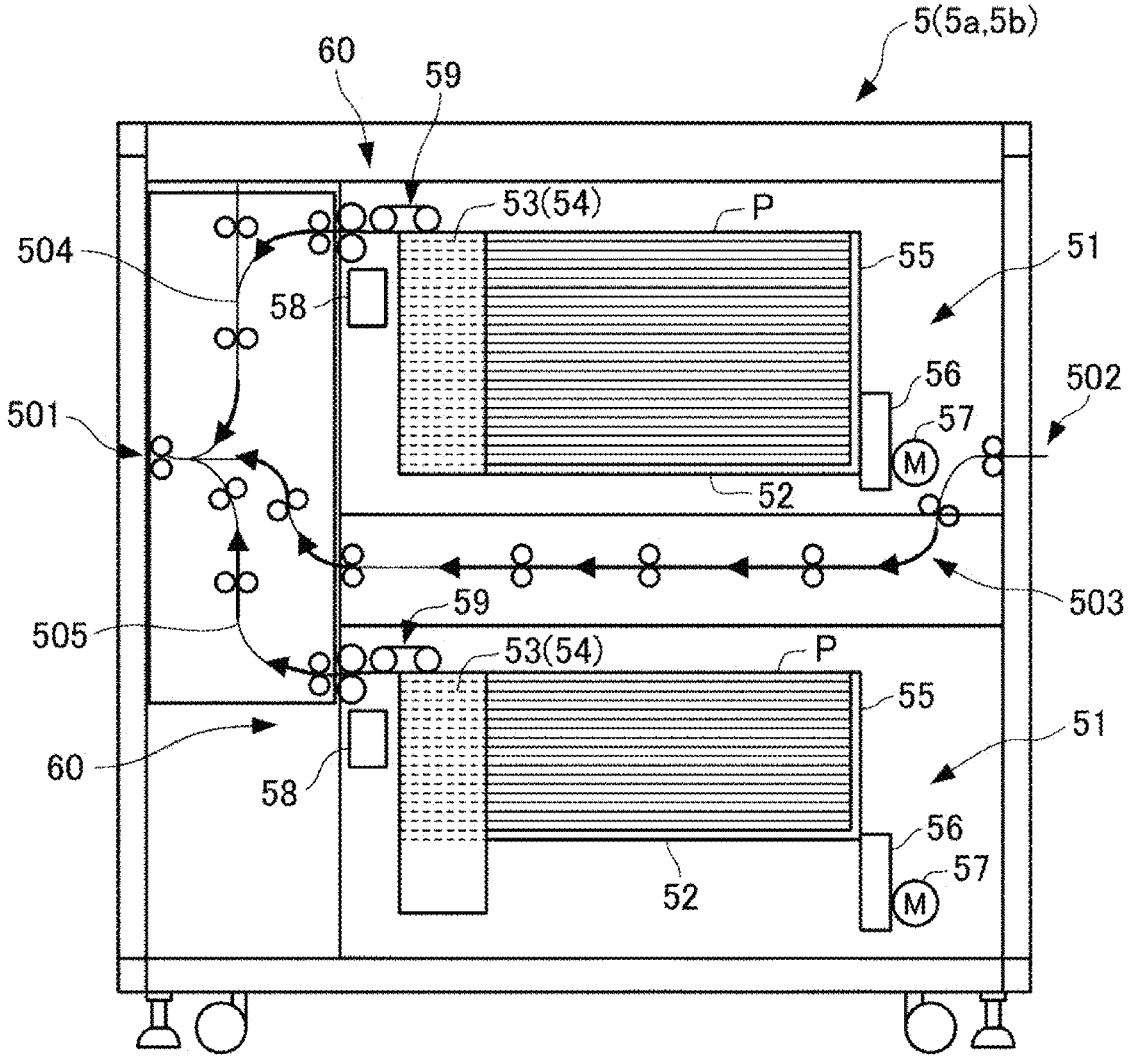
FIG. 2 is a side view of a connectable sheet feeding apparatus, illustrating a configuration of the connectable sheet feeding apparatus.
Figure 3:
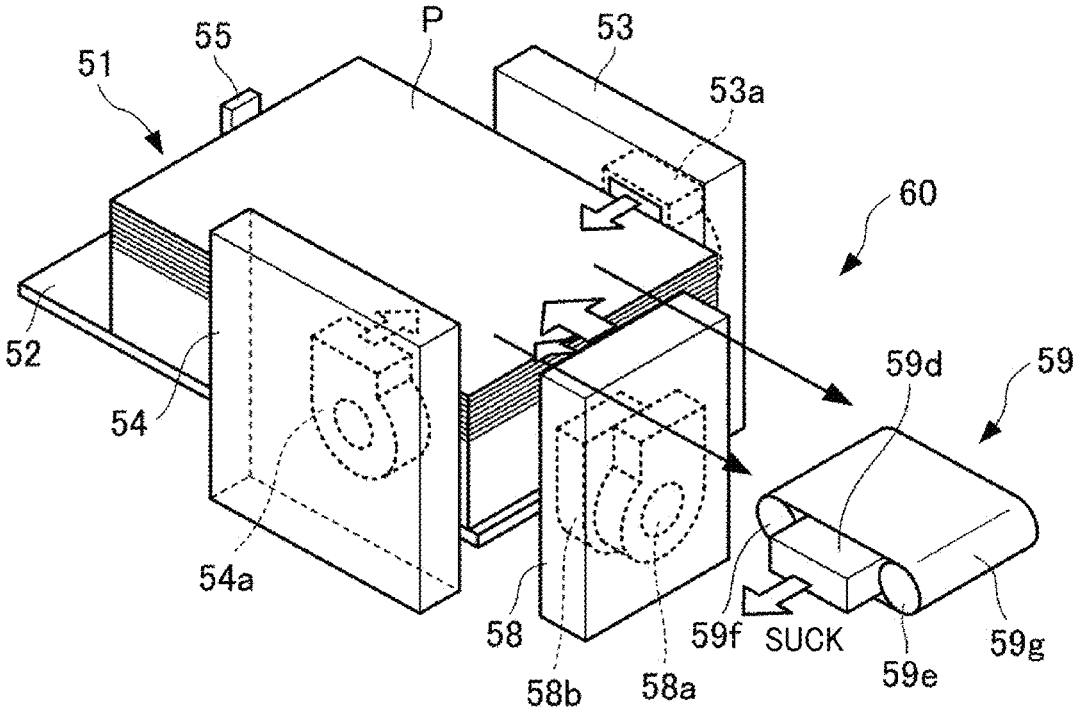
FIG. 3 is a perspective view of an air sheet feeding device, illustrating a configuration of the air sheet feeding device.
Figure 4:
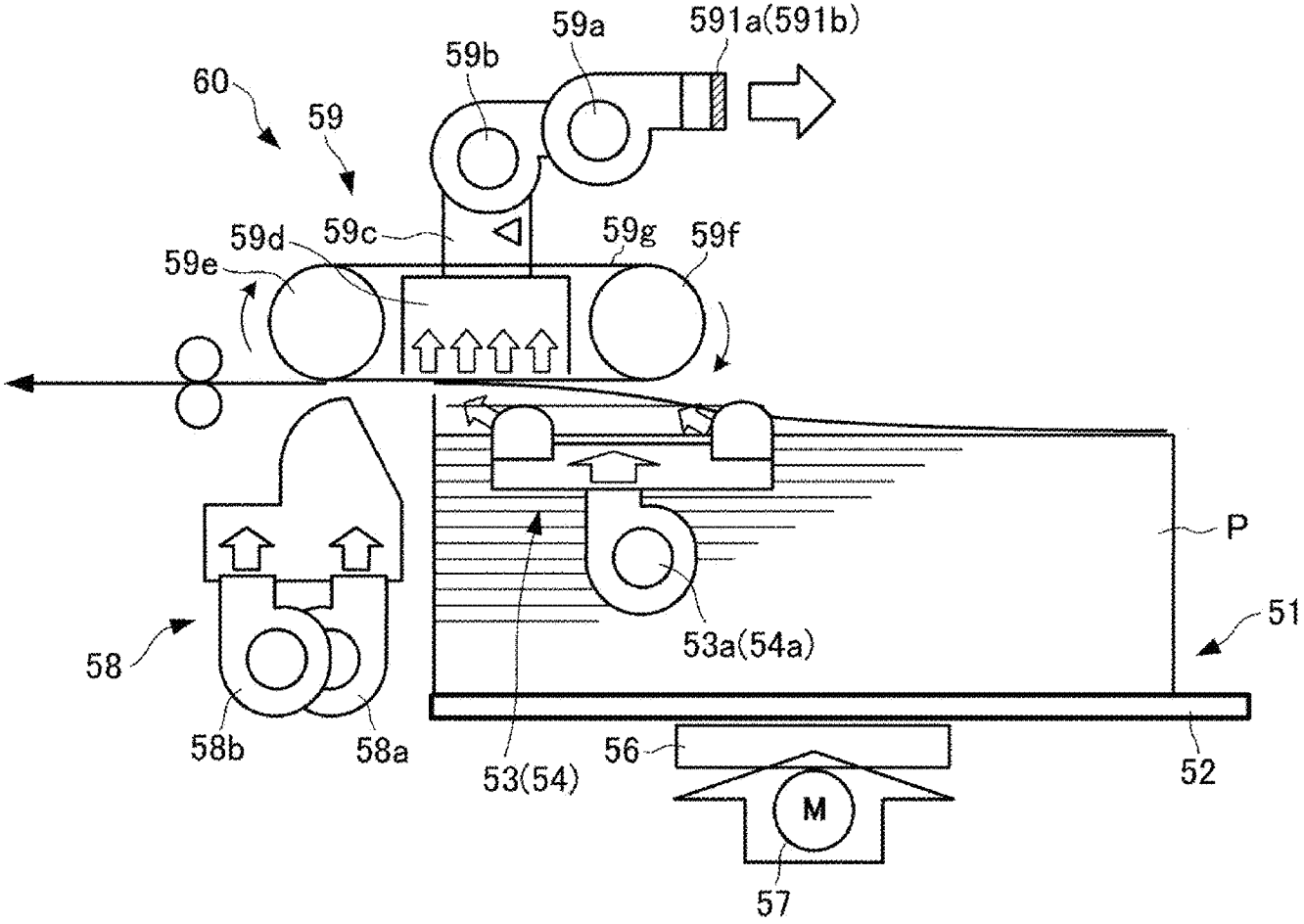
FIG. 4 is an illustration of a side configuration of the air sheet feeding device of FIG. 3.

FIG. 1 is a side view of a printing system, illustrating an overall configuration of the printing system according to the present embodiment. FIG. 2 is a side view of a connectable sheet feeding apparatus, illustrating a configuration of the connectable sheet feeding apparatus according to the present embodiment. FIG. 3 is a perspective view of an air sheet feeding device, illustrating a configuration of the air sheet feeding device according to the present embodiment. FIG. 4 is an illustration of a side configuration of the air sheet feeding device according to the present embodiment. As illustrated in FIG. 1, a printing system 1 according to the present embodiment includes an image forming apparatus 2 and connectable sheet feeding apparatuses 5*a* and 5*b*.

The image forming apparatus 2 is a digital multifunction peripheral (MFP) that includes an apparatus body 2M which includes a sheet feeding unit 3 and an image forming unit 4. The apparatus body 2M further includes a control unit 20 that controls the image forming apparatus 2 and the connectable sheet feeding apparatuses 5*a* and 5*b*. The apparatus body 2M is provided with a control panel 25 such as a touch screen on the upper side of the apparatus body 2M. The control panel 25 displays various kinds of information and receives various kinds of input operations such as starting execution of a print job to the control unit 20.

As illustrated in FIG. 1, the sheet feeding unit 3 includes multiple input trays 31A, 31B, and 31C each of which can store a stack of cut sheets P as recording sheets (e.g., white sheets of paper). In each of the input trays 31A, 31B, and 31C, for example, sheets P of a sheet size selected in advance from multiple sheet sizes are stored in a vertical or horizontal sheet feeding direction in which the sheets P are fed.

The sheet feeding unit 3 includes sheet feeders 30A, 30B, and 30C that pick up the uppermost sheet P one by one from the input trays 31A, 31B, and 31C, respectively, separate the picked sheet P from the other sheets P, and feed the separated sheet P. The sheet feeding unit 3 further includes various rollers 32, which define a sheet feeding passage 33 through which the sheet P fed from one of the sheet feeders 30A, 30B, and 30C to a predetermined image forming position of the image forming unit 4.

The image forming unit 4 includes exposure devices (exposure units) 41K, 41Y, 41M, and 41C and drum-shaped photoconductors 42K, 42Y, 42M, and 42C. The image forming unit 4 further includes developing devices 43K, 43Y, 43M, and 43C filled with black (K), yellow (Y), magenta (M), and cyan (C) toners, respectively. The image forming unit 4 further includes a primary transfer unit 44, a secondary transfer unit 45, and a fixing unit 46.

The exposure devices 41K, 41Y, 41M, and 41C generate laser beams L for exposure of the respective colors based on an image input from, for example, external personal computers (PCs). The exposure devices 41K, 41Y, 41M, and 41C expose the photoconductors 42K, 42Y, 42M, and 42C to the laser beams L to form electrostatic latent images of the respective colors corresponding to the read image on the outer circumferential surface of the photoconductors 42K, 42Y, 42M, and 42C.

The developing devices 43K, 43Y, 43M, and 43C respectively supply thin-layered toner to the photoconductors 42K, 42Y, 42M, and 42C so as to be close to the photoconductors 42K, 42Y, 42M, and 42C, and develop the electrostatic latent images into visible images with the toner.

The image forming unit 4 primarily transfers the toner images developed on the photoconductors 42K, 42Y, 42M, and 42C to the primary transfer unit 44, and secondarily transfers the toner images to the sheet P at the secondary transfer unit 45 adjacent to the primary transfer unit 44. The image forming unit 4 heats and presses the toner image secondarily transferred onto the sheet P with the fixing unit 46 to melt the toner images to fix and record the toner images as a composite color toner image on the sheet P.

The image forming unit 4 includes a conveyance passage 40 to convey the sheet P that has been conveyed through the sheet feeding passage 33 from the sheet feeding unit 3 toward the secondary transfer unit 45. In the conveyance passage 40, the conveyance timing and the conveyance speed of the sheet P are adjusted. After passing through the secondary transfer unit 45 and the fixing unit 46 in synchronization with the belt speed in the primary transfer unit 44 and the secondary transfer unit 45, the sheet P is output onto an output tray 49.

A switchback conveyance passage 47 and a reverse conveyance passage 48 each of which includes multiple conveyance rollers and conveyance guides are disposed below the secondary transfer unit 45 and the fixing unit 46.

When images are formed on both sides of the sheet P, the sheet P having an image fixed on one side enters the switchback conveyance passage 47 from one end of the switchback conveyance passage 47 and is switched back to move in a direction opposite to the direction at the time of entry.

In the reverse conveyance passage 48, the front and back sides of the sheet P that has been switched back in the switchback conveyance passage 47 are reversed, and the sheet P is fed to the conveyance passage 40 again.

In this way, the sheet P having an image fixed on one side is moved backward in its traveling direction in the switchback conveyance passage 47, inverted in the reverse conveyance passage 48, and then enters a secondary transfer nip in the secondary transfer unit 45 again. After having another image secondarily transferred and fixed on the other side, the sheet P is output onto the output tray 49.

In addition to feeding the sheet P through the sheet feeding passage 33 and the conveyance passage 40 from the sheet feeding unit 3 in the apparatus body 2M, the image forming apparatus 2 can feed a sheet P conveyed through a connection passage 500, which is provided on a side of the apparatus body 2M, from the connectable sheet feeding apparatus 5*a* or from the connectable sheet feeding apparatus 5*b* through the connectable sheet feeding apparatus 5*a*.

In the printing system 1, each of the connectable sheet feeding apparatuses 5*a* and 5*b* has the configuration of a connectable sheet feeding apparatus 5 illustrated in FIG. 2. As illustrated in FIG. 2, the connectable sheet feeding apparatus 5 includes two input trays 51, a connection sheet conveyance passage 503 connecting connection passages 501 and 502, and sheet conveyance passages 504 and 505 each connecting the corresponding input tray 51 and the connection passage 501.

The connectable sheet feeding apparatus 5 can be connected to the image forming apparatus 2 such that the connection passage 501 is connected to the connection passage 500 (see FIG. 1) of the image forming apparatus 2. The connectable sheet feeding apparatus 5 can be connected to another connectable sheet feeding apparatus 5 such that the connection passage 502 is connected to the connection passage 501 of the other connectable sheet feeding apparatus 5.

The printing system 1 illustrated in FIG. 1 includes the connectable sheet feeding apparatuses 5*a* and 5*b* as external sheet feeding apparatuses that feed sheets P to the image forming apparatus 2. The connectable sheet feeding apparatus 5*a* conveys the sheets P stacked on the input trays 51 through the corresponding sheet conveyance passages (i.e., through the sheet conveyance passage 504 from the upper input tray 51 in FIG. 1 and through the sheet conveyance passage 505 from the lower input tray 51 in FIG. 1) and sends the sheets P to the conveyance passage 40 through the connection passage 500 of the image forming apparatus 2.

The connectable sheet feeding apparatus 5*b* conveys the sheets P stacked on the input trays 51 through the corresponding sheet conveyance passages (i.e., through the sheet conveyance passage 504 from the upper input tray 51 in FIG. 1 and through the sheet conveyance passage 505 from the lower input tray 51 in FIG. 1) in the own apparatus. The connectable sheet feeding apparatus 5*b* feeds the sheets P to the conveyance passage 40 through the connection sheet conveyance passage 503 of the connectable sheet feeding apparatus 5*a* and the connection passage 500 of the image forming apparatus 2.

In the printing system 1, the image forming apparatus 2 and the connectable sheet feeding apparatuses 5*a* and 5*b* are electrically connected to each other when the image forming apparatus 2 and the connectable sheet feeding devices 5*a* and 5*b* are connected to each other so that the sheets P are fed under the control of the control unit 20.

Referring back to FIG. 2, a description is given below of the configuration of the connectable sheet feeding apparatus 5. In the connectable sheet feeding apparatus 5, each of the input trays 51 includes a tray bottom plate 52, side fences 53 and 54, an end fence 55, an elevation assembly 56, and an elevation motor 57.

Multiple sheets P can be stacked on the tray bottom plate 52 of the input tray 51. The tray bottom plate 52 can be moved up and down by the elevation assembly 56 driven by the elevation motor 57 described later while the sheets P are stacked on the tray bottom plate 52 as a stack of sheets P. The tray bottom plate 52, the elevation assembly 56, and the elevation motor 57 construct elevation means according to the present embodiment.

The side fences 53 and 54 of the input tray 51 restrict the widthwise movement of the sheets P stacked on the tray bottom plate 52. The end fence 55 is disposed so as to be adjacent to the trailing end of the sheets P stacked on the tray bottom plate 52 in a sheet conveyance direction in which the sheets P are conveyed. The end fence 55 restricts the movement of the sheets P in the direction opposite to the sheet conveyance direction. The elevation assembly 56 is coupled between the tray bottom plate 52 and the elevation motor 57 to move up and down the tray bottom plate 52, that is, the sheets P on the tray bottom plate 52, by the rotation of the elevation motor 57.

The connectable sheet feeding apparatus 5 includes air sheet feeding devices 60, which are air-pickup sheet feeding devices that blow air into the stack of sheets P on the input trays 51 to float and separate the sheets P to suck the sheets P one by one by air and feed the sucked sheet P to the corresponding sheet conveyance passages 504 and 505.

As illustrated in FIGS. 2 to 4, each of the air sheet feeding devices 60 includes the tray bottom plate 52, the side fences 53 and 54, and the end fence 55 which construct the input tray 51; an air sheet feeding unit 58; and a belt sheet feeding unit 59.

The air sheet feeding unit 58 is disposed downstream from the tray bottom plate 52 in the sheet conveyance direction. The air sheet feeding unit 58 includes a floating fan 58*a* and a separation fan 58*b* as blower fans to blow air to the sheets P from a place adjacent to the leading end of the sheets P in the sheet conveyance direction. The floating fan 58*a* and the separation fan 58*b* blow air to the stack of sheets P from the place adjacent to the leading end of the sheets P in the sheet conveyance direction to float and separate sheets P in a predetermined area below the uppermost sheet P of the stack of sheets P on the tray bottom plate 52.

The side fence 53 of the input tray 51 includes a side fan 53*a* as a blower fan to blow air from one side of the sheets P. Similarly, the side fence 54 includes a side fan 54*a* as a blower fan to blow air from the opposite side of the sheets P. The side fans 53*a* and 54*a* blow air to the stack of sheets P from both sides thereof to facilitate the sheets P to float and separate.

As illustrated in FIGS. 3 and 4, the belt sheet feeding unit 59 includes air suction fans 59*a* and 59*b*, a suction duct 59*c*, a suction chamber 59*d*, a pair of feed rollers 59*e* and 59*f*, and a suction belt 59*g*.

The air suction fans 59*a* and 59*b* suck air in the suction chamber 59*d* through the suction duct 59*c* whose opening faces the upper surface of the uppermost sheet P of the stack of sheets P on the tray bottom plate 52. The air suction fans 59*a* and 59*b* includes air filters 591*a* and 591*b*, respectively, to remove paper dust, calcium carbonates, dust, and dirt so as not to be discharged to the outside of the machine.

The suction belt 59*g* is, for example, a rubber endless belt that is stretched between the pair of feed rollers 59*e* and 59*f* so as to face the opening of the suction chamber 59*d*. The sheet P is sucked to the suction belt 59*g* by air sucked by the air suction fans 59*a* and 59*b*. The pair of feed rollers 59*e* and 59*f* is rotated by a belt drive motor to convey the suction belt 59*g* sucking the sheet P downstream in the sheet conveyance direction.

With the above-described configuration, the belt sheet feeding unit 59 sucks the sheets P, which are floated and separated by air blowing from the air sheet feeding unit 58, with the suction belt 59*g* one by one from the uppermost sheet P by the suction of air through the suction duct 59*c*. Thereafter, in the belt sheet feeding unit 59, the pair of feed rollers 59*e* and 59*f* is rotated to rotate the suction belt 59*g* to feed and convey the sheet P sucked to the circumferential surface of the suction belt 59*g* downstream in the sheet conveyance direction.

In the air sheet feeding device 60, in the sheet feeding operation control of the sheets P, the side fans 53*a* and 54*a*, the floating fan 58*a*, the separation fan 58*b*, and the air suction fans 59*a* and 59*b* are selectively rotated at respective activation timings in accordance with the sheet feeding timing.

In the air sheet feeding device 60, when the floating fan 58*a* and the separation fan 58*b* start to rotate, air generated by the respective rotations is blown to the leading end of the sheets P as separation air for separating the sheets P and floating air for floating the entire stacked sheets P through different duct passages.

In the air sheet feeding device 60, when the side fan 53*a* of the side fence 53 and the side fan 54*a* of the side fence 54 start to rotate, side air is blown to the sides of the sheets P and the entire stacked sheets P are floated like when the floating fan 58*a* starts to rotate.

In the air sheet feeding device 60, when the air suction fans 59*a* and 59*b* start to rotate, the suction air through the suction duct 59*c* brings the suction chamber 59*d* in the belt sheet feeding unit 59 into a negative pressure state to suck the uppermost sheet P of the stack of sheets P. When the uppermost sheet P is sucked to the suction belt 59*g*, the suction belt 59*g* is rotated to convey the sheet P to the apparatus body 2M of the image forming apparatus 2.

In the sheet feeding operation described above, the air volumes and the switching between ejection and blocking of air of the side fans 53*a* and 54*a*, the floating fan 58*a*, the separation fan 58*b*, and the air suction fans 59*a* and 59*b* are automatically controlled by the control unit 20 by determining the sheet feeding parameters according to the sheet type, the sheet thickness, and the sheet size.

Figure 5:
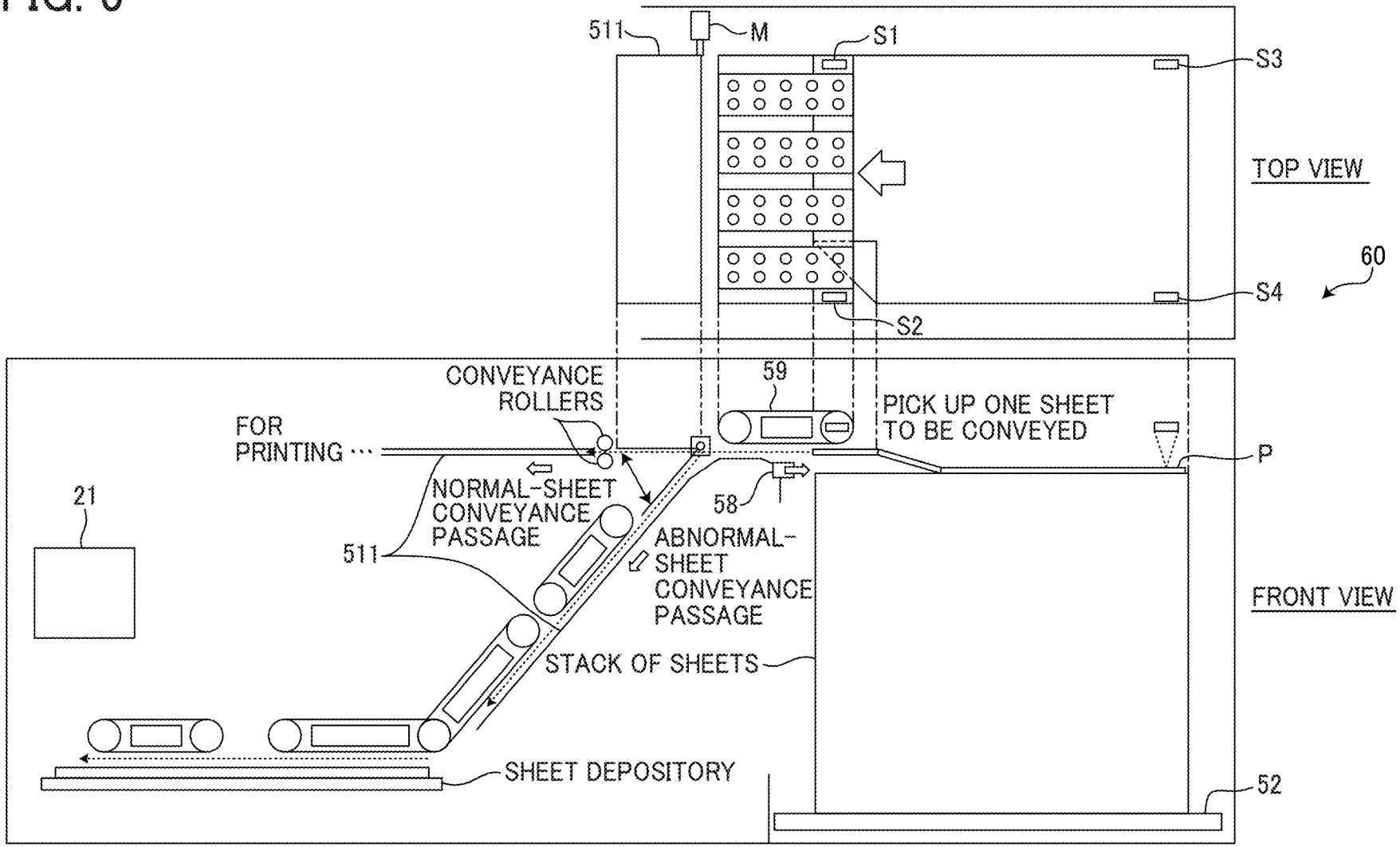
FIG. 5 is a diagram illustrating a hardware configuration of the air sheet feeding device included in the printing system of FIG. 1.

FIG. 5 is a diagram illustrating a hardware configuration of the air sheet feeding device 60 included in the printing system 1 according to the present embodiment. The air sheet feeding device 60 (an example of a sheet feeding device) according to the present embodiment includes an air pick belt (the suction belt 59*g*) to convey by suction a sheet P (an example of a sheet) which is a sheet to be conveyed, two types of sensors (range finders S1 and S2 and optical sensors S3 and S4) to detect the state of the sheet P (sheet state), a mechanical conveyance assembly (a motor M and a passage changing plate 511) to change the passage for conveying the sheet P, and a control board 21 to control the conveyance of the sheet P in the air sheet feeding device 60.

Since a folded or torn sheet P may physically collide with a roller or the passage while being conveyed by rollers, an air pick belt (the suction belt 59*g*) that can convey the sheet P by air suction is employed. Since an abnormal state such as folding is likely to occur particularly at the four corners of the sheet P, various sensors are disposed to face the four corners of the sheet P to detect the sheet state. In typical detection of the sheet state (with sensors such as optical sensors or pressure sensors), the sensors can accurately detect the sheet state only when the sheet P is stably conveyed. Thus, the sensors have difficulties in accurate detection of the leading end of the sheet P in the sheet conveyance direction while the sheet P is floated by the air pick belt (the suction belt 59*g*). According to the present embodiment, to simply determine an abnormal sheet state, the optical sensors S3 and S4 (or other sensors) that can accurately detect the sheet P as in typical cases are employed to detect the trailing end of the sheet P in the sheet conveyance direction and the range finders S1 and S2 are employed to detect the leading end of the sheet P in the sheet conveyance direction.

Figure 6:
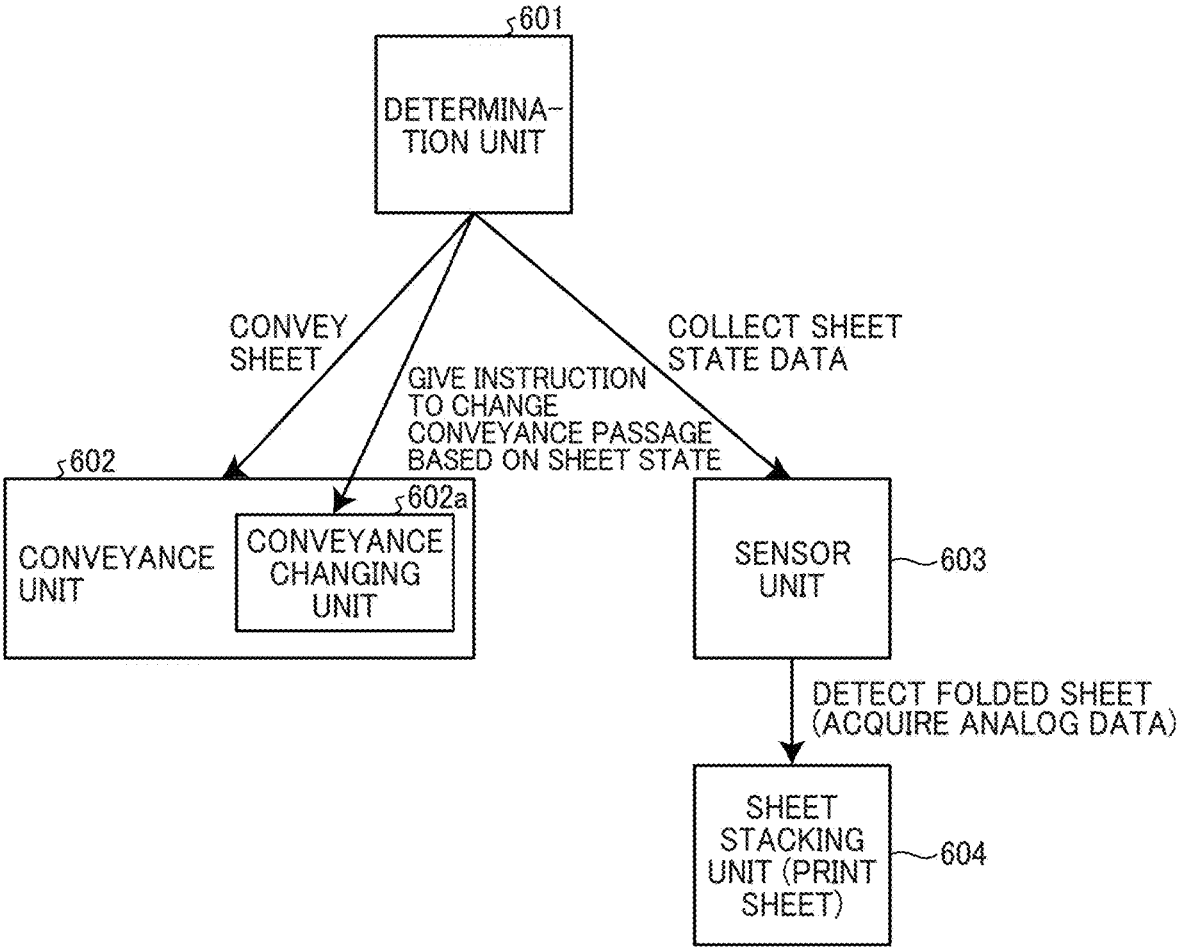
FIG. 6 is a diagram illustrating a functional configuration of the air sheet feeding device included in the printing system of FIG. 1.

FIG. 6 is a diagram illustrating a functional configuration of the air sheet feeding device 60 included in the printing system 1 according to the present embodiment. As illustrated in FIG. 6, the air sheet feeding device 60 according to the present embodiment includes a determination unit 601, a conveyance unit 602, a sensor unit 603, and a sheet stacking unit 604.

The sheet stacking unit 604 is an example of a sheet stacker on which the sheets P are stacked. The sheet stacking unit 604 is implemented by, for example, the tray bottom plate 52. The conveyance unit 602 is an example of a conveyor that conveys the sheet P from the sheet stacking unit 604 by suction. The conveyance unit 602 is implemented by, for example, an air pick belt (the suction belt 59*g*) that can convey the sheet P by suction. Since a folded or torn sheet P (abnormal sheet P) may physically collide with a roller or the passage and cause a paper jam while being conveyed by rollers, the air pick belt that can convey the sheet P by air suction is employed to convey the abnormal sheet P.

The sensor unit 603 is an example of a sensor that detects a sheet state before the sheet P is conveyed from the sheet stacking unit 604. The sensor unit 603 is implemented by, for example, the range finders S1 and S2 and the optical sensors S3 and S4. Specifically, the sensor unit 603 detects the sheet state at the stage where the sheet P is picked up and separated from the second sheet in the sheet stacking unit 604. More specifically, the sensor unit 603 detects the state of the sheet P on the sheet stacking unit 604 between the time the sheet P is sucked by the conveyance unit 602 and the time the sheet P reaches a conveyance changing unit 602*a* described later. Such detection of the sheet state before conveyance by the rollers prevents an error such as a paper jam. The sensor that implements the sensor unit 603 may be disposed on the tray bottom plate 52. At least one sensor unit 603 may be implemented by the range finder S1. With such a configuration, the sheet state can be detected even when the sheet P is unstable because the sheet P is air-picked. The sensor that implements the sensor unit 603 may be disposed at a position corresponding to each of the four corners of the sheet P. The optical sensors S3 and S4 may be disposed upstream in the sheet conveyance direction whereas the range finders S1 and S2 may be disposed downstream in the sheet conveyance direction. By placing typical optical sensors upstream in the direction of conveyance of the sheet P, steps of a folded sheet can be detected with high accuracy and the sheet state can be determined.

The determination unit 601 is an example of a determination device that determines the state of the sheet P (whether the sheet is normal or abnormal) based on a detection result of the sensor unit 603. The determination unit 601 is implemented by, for example, the control board 21. The conveyance unit 602 includes the conveyance changing unit 602*a*. The conveyance changing unit 602*a* is implemented by, for example, the mechanical conveyance assembly including the passage changing plate 511. The conveyance changing unit 602*a* changes the passage for conveying the sheet P, based on a determination result of the determination unit 601. Since the air sheet feeding device 60 has functions of detecting the sheet state during the printing operation and before a sheet is conveyed and removing a sheet detected as an abnormal sheet without conveying the abnormal sheet to a normal conveyance route, the air sheet feeding device 60 can exclude a sheet that may cause malfunction in conveyance ahead of time without stopping the printing operation. As a result, the machine downtime can be reduced by detecting the abnormal sheet at the initial stage and removing the jammed sheet without stopping the printing operation.

As a flow of functions of the entire air sheet feeding device 60, the sensor unit 603 (e.g., the range finders S1 and S2) detects the sheet state of the sheets P (sheets to be conveyed) stacked on the sheet stacking unit 604 (e.g., the tray bottom plate 52), and the determination unit 601 determines the sheet state (e.g., whether the sheet P is folded) based on the data output by the sensor unit 603. Then, the air sheet feeding device 60 conveys the sheet P while the conveyance changing unit 602*a* of the conveyance unit 602 changes the passage for conveying the sheet P, in accordance with an instruction from the determination unit 601 based on the determination result of the sheet state such as whether the sheet P is folded. Since the passage for conveying the sheet P detected as an abnormal sheet is automatically changed from a normal-sheet conveyance passage for conveying the normal sheet P to an abnormal-sheet conveyance passage for conveying the abnormal sheet P, the air sheet feeding device 60 can continue the printing operation without stopping the conveyance of the sheet P.

Figure 7A:
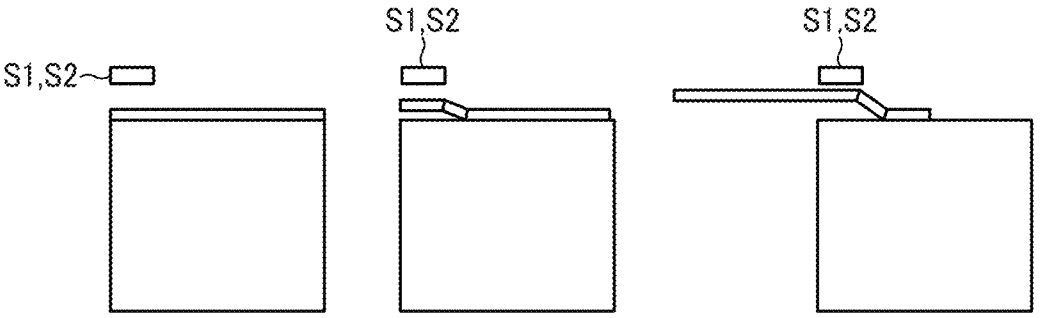
FIGS. 7A to 7C are diagrams illustrating an example of detection of a sheet state in the air sheet feeding device included in the printing system of FIG. 1.
Figure 7B:
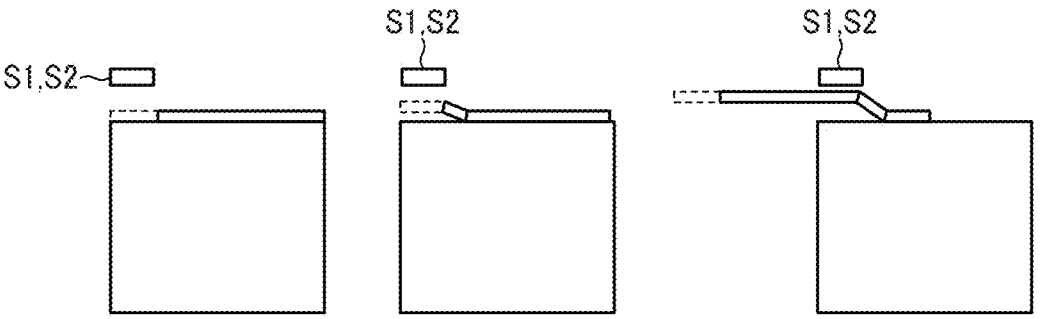
Figure 7C:
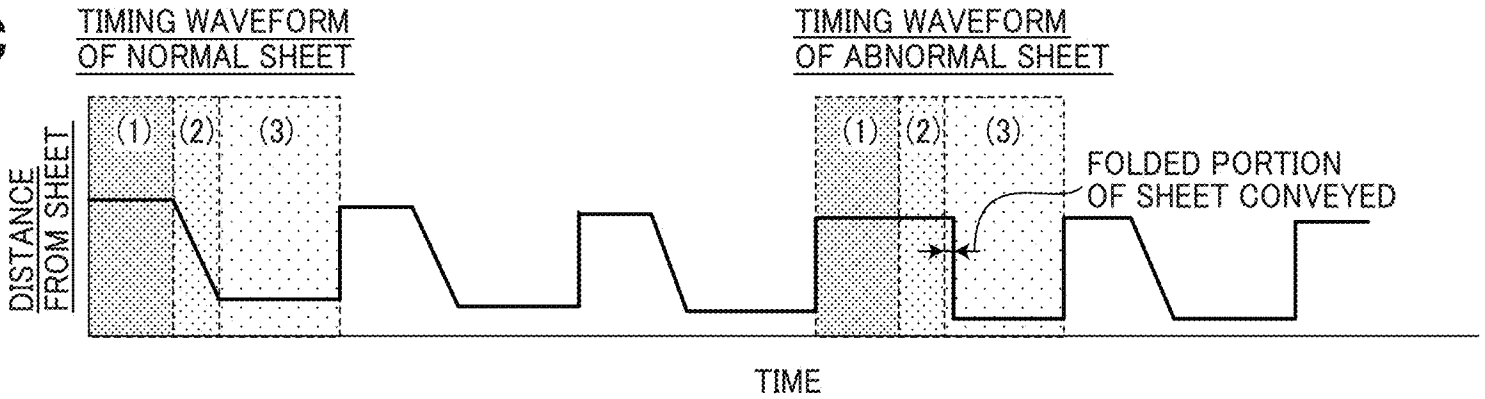

FIGS. 7A to 7C are diagrams illustrating an example of detection of the sheet state in the air sheet feeding device 60 included in the printing system 1 according to the present embodiment. Specifically, FIG. 7A is a diagram illustrating an example of operation of conveying a normal sheet. FIG. 7B is a diagram illustrating an example of operation of conveying an abnormal sheet. FIG. 7C is a timing waveform illustrating an example of detection of the sheet state by the range finders S1 and S2 that implement the sensor unit 603.

A description is given below of an operation in a case where the state of the sheet P is normal, that is, the sheet P is a normal sheet. Since the sheets P are stacked at first, the distance between the sheets P (stacked sheets) and the range finders S1 and S2 is the maximum. A sheet depository (the tray bottom plate 52) moves up and down to keep the distance between the stacked sheets and the range finders S1 and S2 constant (timing (1)). As the sheet P is floated by the air pick belt (the suction belt 59*g*), the distance between the stacked sheets and the range finders S1 and S2 is reduced (timing (2)). The sheet P is conveyed when the sheet P is completely floated (that is, when the distance between the range finders S1 and S2 and the sheet P is minimum). After the conveyance of the sheet P is completed, the waveform returns to the state at the timing (1) (timing (3)).

In a case where the state of the sheet P is abnormal, that is, the sheet P is an abnormal sheet, even when the leading end of the sheet P in the sheet conveyance direction is floated at the timing (2), the sheet P is not present at the reading positions of the range finders S1 and S2 because the sheet P is an abnormal sheet (e.g., the sheet P is folded), and thus the distance between the stacked sheets and the range finders S1 and S2 is unchanged. For this reason, the determination unit 601 can determine whether the sheet P is abnormal based on the data (the state data at the timing (2)) acquired by the range finders S1 and S2 during the conveyance.

Figure 8:
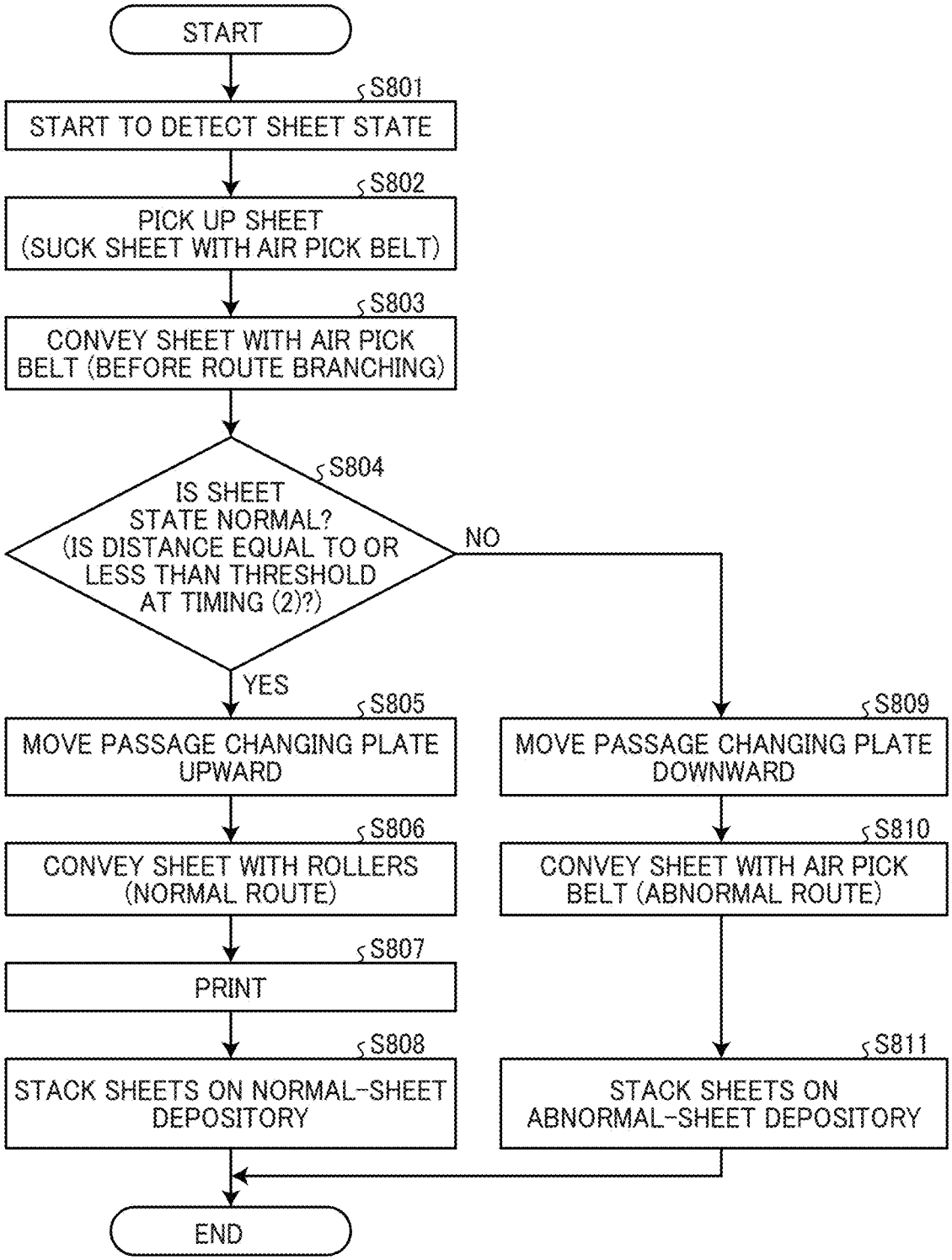
FIG. 8 is a flowchart of a process to change conveyance passages in the air sheet feeding device included in the printing system of FIG. 1.

FIG. 8 is a flowchart of a process to change conveyance passages in the air sheet feeding device 60 included in the printing system 1 according to the present embodiment. In step S801, the sensor unit 603 of the air sheet feeding device 60 starts to detect the state of the sheet P when the conveyance of the sheet P is started. In step S802, the suction belt 59*g* picks up the sheet P from the sheet stacking unit 604. In step S803, the suction belt 59*g* conveys the picked sheet P. In step S804, the determination unit 601 determines whether the sheet state is normal based on the sheet state detected by the sensor unit 603. Specifically, the determination unit 601 determines whether the distance between the sheet P and the range finders S1 and S2 is equal to or less than a threshold at the timing (2).

When the determination unit 601 determines that the sheet state is normal (Yes in step S804), in step S805, the conveyance changing unit 602*a* of the conveyance unit 602 moves the passage changing plate 511 upward. More specifically, the determination unit 601 outputs a control signal to drive the motor M to move the passage changing plate 511 upward. In step S806, the rollers convey the sheet P. In step S807, the image forming unit 4 prints an image on the sheet P. In step S808, the sheet P rests on a normal-sheet depository. In this way, multiple normal sheets P are stacked on the normal-sheet depository.

By contrast, when the determination unit 601 determines that the sheet state is abnormal (NO in step S804), in step S809, the conveyance changing unit 602*a* moves the passage changing plate 511 downward. More specifically, the determination unit 601 outputs a control signal to drive the motor M to move the passage changing plate 511 downward. In step S810, the suction belt 59*g* conveys the sheet P. In step S811, the sheet P rests on an abnormal-sheet depository. In this way, multiple abnormal sheets P are stacked on the abnormal-sheet depository.

As described above, in the air sheet feeding devices 60 according to the present embodiment, the passage changing plate 511 is moved based on the sheet state detected immediately before the sheet P is conveyed so that, when the sheet state is normal, the sheet P is conveyed to the normal conveyance passage by the conveyance rollers as in typical cases and, when the sheet state is abnormal, the sheet P is automatically sorted to the abnormal conveyance passage with the air pick belt. By detecting the sheet state at the initial stage of printing and immediately changing the conveyance passage based on the detected sheet state, a malfunction such as a paper jam can be prevented without stopping the printing operation and the machine downtime caused by an abnormal sheet can be eliminated.

In the embodiment described above, the image forming apparatus 2 is described as an MFP having at least two of copying, printing, scanning, and facsimile functions. Alternatively, the image forming apparatus 2 may be, for example, a copier, a printer, a scanner, or a facsimile machine.

A description is given below of several aspects of the present disclosure.

According to a first aspect, a sheet feeding device includes a sheet stacker, a conveyor, a sensor, a determination device, and a changing unit. The conveyor conveys a sheet from the sheet stacker by suction. The sensor detects a state of the sheet before the sheet is conveyed from the sheet stacker. The determination device determines the state of the sheet (whether the sheet is normal or abnormal) based on a detection result of the sensor. The changing unit changes a passage to convey the sheet based on a determination result of the determination device.

According to a second aspect, in the sheet feeding device of the first aspect, the sensor detects the state of the sheet at a stage where the sheet is picked up and separated from the second sheet on the sheet stacker.

According to a third aspect, in the sheet feeding device of the first or second aspect, the sensor detects the state of the sheet on the sheet stacker between the time the sheet is sucked by the conveyor and the time the sheet reaches the changing unit.

According to a fourth aspect, the sheet feeding device of any one of the first to third aspects, further includes multiple sensors including the sensor on the sheet stacker. At least one of the sensors is a range finder.

According to a fifth aspect, in the sheet feeding device of any one of the first to fourth aspects, the sensor is disposed at a position corresponding to each of the four corners of the sheet, and optical sensors are disposed upstream in a sheet conveyance direction in which the sheet is conveyed whereas range finders are disposed downstream in the sheet conveyance direction.

According to a sixth aspect, in the sheet feeding device of any one of the first to fifth aspects, the conveyor is an air pick belt that can convey the sheet by suction.

According to a seventh aspect, an image forming apparatus or a printing system includes the sheet feeding device of any one of the first to sixth aspects.

According to one or more aspects of the present disclosure, machine downtime can be reduced by detecting an abnormal sheet at an initial stage and removing a jammed sheet without stopping a printing operation.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application-specific integrated circuits (ASICs), field-programmable gate arrays (FPGAs), and/or combinations thereof which are configured or programmed, using one or more programs stored in one or more memories, to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein which is programmed or configured to carry out the recited functionality.

There is a memory that stores a computer program which includes computer instructions. These computer instructions provide the logic and routines that enable the hardware (e.g., processing circuitry or circuitry) to perform the method disclosed herein. This computer program can be implemented in known formats as a computer-readable storage medium, a computer program product, a memory device, a record medium such as a compact disc read-only memory (CD-ROM) or digital versatile disk (DVD), and/or the memory of an FPGA or ASIC.

The invention claimed is:

1. A sheet feeding device, comprising:

a sheet stacker;

a conveyor to convey a sheet from the sheet stacker by suction;

a sensor to detect a state of the sheet before the sheet is conveyed from the sheet stacker;

circuitry configured to determine the state of the sheet based on a detection result of the sensor; and a changing unit to change a passage to convey the sheet based on a determination result.

2. The sheet feeding device according to claim 1, wherein the sensor detects the state of the sheet picked up and separated from another sheet on the sheet stacker.

3. The sheet feeding device according to claim 1, wherein the sensor detects the state of the sheet between a time the sheet is sucked by the conveyor and a time the sheet reaches the changing unit.

4. The sheet feeding device according to claim 1, further comprising a plurality of sensors including the sensor on the sheet stacker, wherein at least one of the plurality of sensors is a range finder.

5. The sheet feeding device according to claim 1, further comprising a plurality of sensors including the sensor at positions corresponding to four corners of the sheet, wherein the plurality of sensors include:

optical sensors upstream in a sheet conveyance direction in which the sheet is conveyed; and range finders downstream in the sheet conveyance direction.

6. The sheet feeding device according to claim 1, wherein the conveyor is an air pick belt to convey the sheet by suction.

7. A printing system, comprising:

the sheet feeding device according to claim 1; and an image forming apparatus to form an image on the sheet conveyed by the sheet feeding device.

* * * * *